US005367711A

United States Patent [19]

Calagui

[11] Patent Number: 5,367,711

[45] Date of Patent: Nov. 29, 1994

[54] PROTECTIVE WORK GLOVE WITH RIGID PORTIONS

[76] Inventor: Juanito B. Calagui, P.O. Box 325, Passaic, N.J. 07055

[21] Appl. No.: 895,365

[22] Filed: Jun. 8, 1992

[51] Int. Cl.[5] ..... A41D 19/00

[52] U.S. Cl. ..... 2/161.6; 2/163

[58] Field of Search ..... 2/163, 161 R, 158, 159, 2/16, 20, 161.6, 161.8, 907

[56] References Cited

U.S. PATENT DOCUMENTS

| | | | |
|---|---|---|---|
| 217,814 | 7/1879 | Munthe | 2/158 |
| 2,645,778 | 7/1953 | Probert | 2/158 |
| 2,884,644 | 5/1959 | Jefferson | 2/158 |
| 2,923,946 | 2/1960 | Nielsen | 2/20 X |
| 3,184,756 | 5/1965 | DeLuca, Jr. | 2/161 R |
| 3,290,695 | 12/1966 | Burtoff | 2/161 R |
| 3,386,104 | 6/1968 | Casey | 2/161 R |

FOREIGN PATENT DOCUMENTS

| | | | |
|---|---|---|---|
| 123746 | 1/1972 | Norway | 2/161 R |
| 764647 | 9/1980 | U.S.S.R. | 2/158 |

*Primary Examiner*—Clifford D. Crowder
*Assistant Examiner*—Larry D. Worrell, Sr.
*Attorney, Agent, or Firm*—M. K. Silverman

[57] ABSTRACT

A protective work glove defines a first enclosure integrally extending from a palm portion of the glove and defining pathways therein the middle and index fingers. Between such fingers is secured a rigid body proportioned in height to at least the height of the finger pathways and extending in length from the knuckle to beyond the tips of the finger of the user. The protective work glove also includes a second enclosure integrally extending from the palm portion in which there are defined therein pathways for the ring and pinkie fingers. Between said pathways is provided a rigid body portioned in height to at least the height of the finger pathways and extending from the knuckle to beyond the fingertips of the user.

3 Claims, 2 Drawing Sheets

PROTECTIVE WORK GLOVE WITH RIGID PORTIONS

BACKGROUND OF THE INVENTION

Blue collar type workers are subject to a variety of types of occupational hazards. One type of hazard is that associated with the movement or stacking of heavy materials. Within this category of hazard is that activity associated with the movement of heavy pipes and other elongated cylindrical objects that are inheritantly unstable and, as such, are apt to move or roll, given the slightest disturbance of a pile of stacked pipes or cylindrical objects.

One type of industrial accident that has been by-product of work with such heavy pipes and the like is that the fingers of the worker can become easily crushed upon the occurrence even a minor accident involving the uncontrolled movement over even a short distance of a small number of pipes.

While various types of protective gloves are known in the art, there does not, to the knowledge of the inventor, exist a protective glove for industrial workers particularly designed to afford protection against the risk of crushed fingers in which such a glove does not impair the overall agility of the worker to perform the necessary handling function relative to stacking and lifting of heavy pipes and like structures. Accordingly, the instant invention may be understood as a response to the long felt need to provide a protective work glove particularly adapted for use by industrial workers whose efforts are directed to the positioning and arrangement of heavy pipes and other cylindrical objects.

SUMMARY OF THE INVENTION

The present invention relates to a protective work glove for industrial workers. The inventive glove includes a thumb enclosure integrally extending outwardly from a palm portion of the glove. The work glove further includes a first enclosure integrally extending from said palm portion, said enclosure defining a volume there within for accommodation of the middle and index fingers, said volume having proximal and distal areas relative to the palm portion, and having therebetween a rigid body having the generalized shape of an isosceles triangle proportioned in height to about the height of said finger pathways of said first enclosure. The work glove yet further includes a second enclosure integrally extending from said palm portion, said enclosure defining a volume therewithin for the accommodation of the ring and pinkie fingers, said pathways having proximal and distal areas relative to the palm portion and having therewithin a rigid body having the generalized shape of an isosceles triangle proportioned in height to about the height of said second enclosure, and extending to the distal end of the pathway, in which said first and second bodies will provide protection against crushing of the index, middle, ring and pinkie fingers.

It is accordingly an object of the present invention to provide a protective work glove particularly adapted to afford protection to the fingers of industrial workers concerned with the positioning and movement of heavy pipes and like objects.

It is another object of the present invention to provide a work glove of the above type which, while affording protection to the fingers of the worker, will permit the worker to execute all activities relative to the movement and positioning of heavy piping and like objects.

The above and yet other objects and advantages of the present invention will become apparent in the hereinafter set forth Brief Description of the Drawings, Detailed Description of the Invention, and Claims appended herewith.

DETAILED DESCRIPTION OF THE INVENTION

Figure 1:
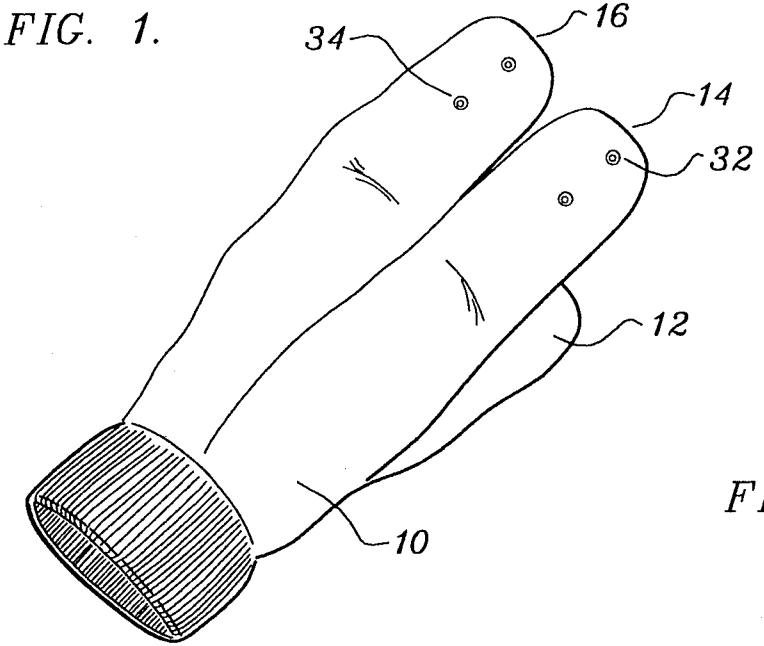
FIG. 1 is a perspective view of the inventive protective work glove.
Figure 2:
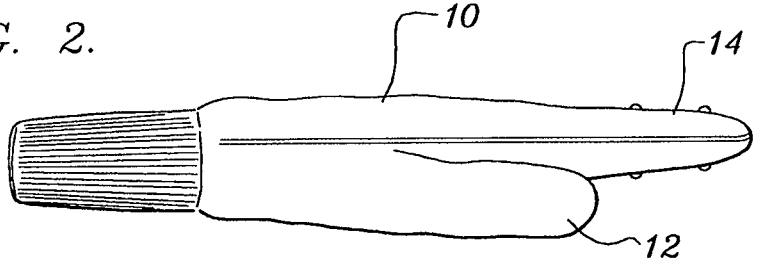
FIG. 2 is the thumb side view of the glove of FIG. 1.
Figure 3:
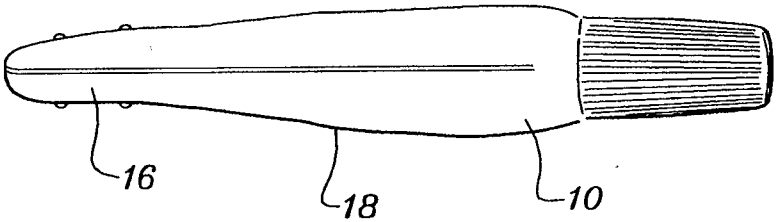
FIG. 3 is a pinkie side view of the glove of FIG. 1.

With reference to FIG. 1 there is shown a protective work glove 10 in accordance with the present invention. It is noted that the glove 10 is characterized by a thumb enclosure 12, a first enclosure 14 proportioned in size to the size of the middle and index fingers, and a second enclosure 16 which is proportioned in size to the ring and pinkie fingers. The gloves are also provided with a palm portion 18, shown in side view in FIG. 3.

Figure 4:
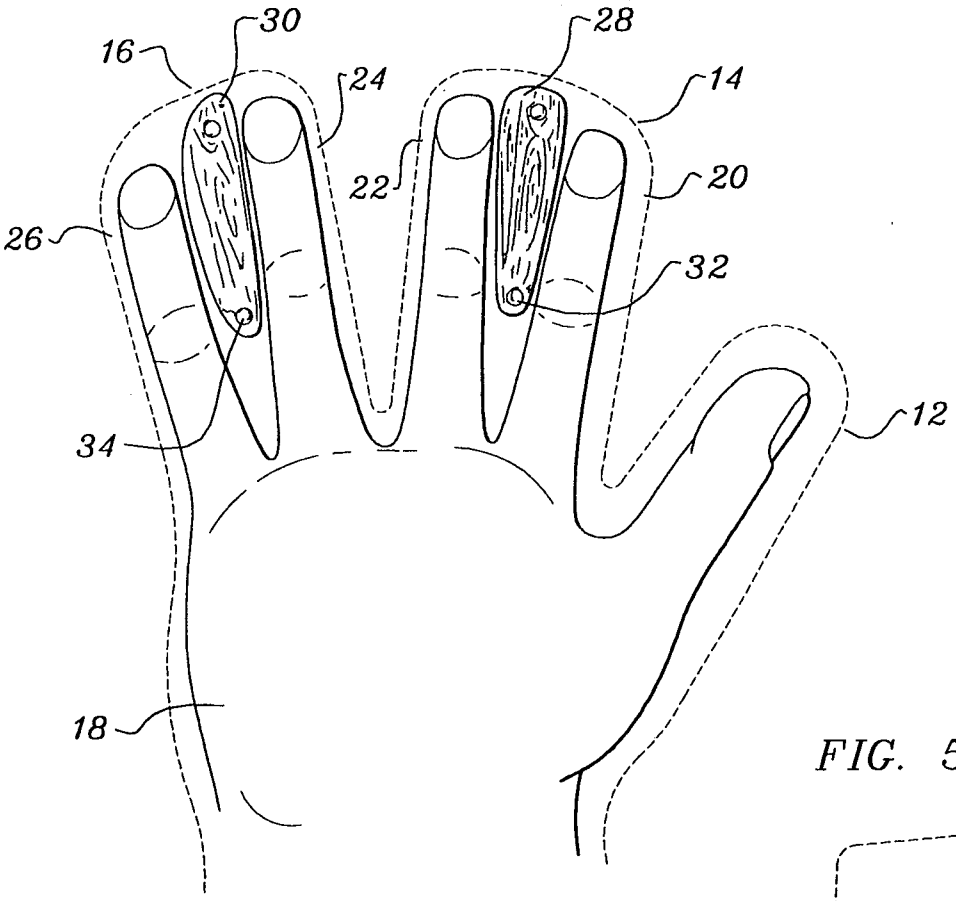
FIG. 4 is a schematic, breakaway, operational view of the inventive glove showing the protective rigid body portions secured internally there within.

As may be seen in the schematic view of FIG. 4, said first enclosure 14 is provided with a non-circumferential pathway 20 for the index finger and a non-circumferential pathway 22 for the middle finger. Similarly, said second enclosure 16 is provided with a non-circumferential ring finger pathway 24 and a non-circumferential pinkie finger pathway 26.

Figure 5:
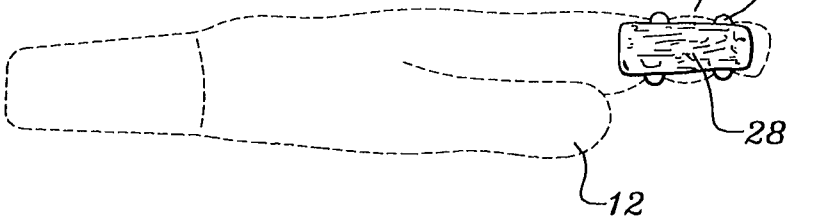
FIG. 5 is a thumb side view similar in direction to the view of FIG. 2, however showing the protective rigid body within the index-middle finger pathway thereof.

As may be further noted in the view of FIG. 4 there is provided between said finger pathways 20 and 22of a first enclosure 14, a first rigid body 28 having, in top view, the generalized shape of an isosceles triangle which is proportioned in height to at least the height of said pathways 20 and 22 (see FIG. 5) of said first enclosure 14. Similarly, between said ring and pinkie pathways 24 and 26 respectively of said second enclosure 16, there is provided a second rigid body 30 having, in top view, the generalized shape of an isosceles triangle the height of which is also proportioned to at least the height of the fingers in pathways 24 and 26. It may be further noted, said rigid bodies 28 and 30 preferably extend from the region of the knuckle of the user to beyond the fingertips of the user. They may be permanently secured in place through the use of rivets 32 in the first enclosure 14 and rivets 34 in the second enclosure 16.

It has been determined that the limitation in movement of the index finger relative to the middle finger, and of the ring finger relative to the pinkie finger, which is associated with the above described inventive structure does not reduce or compromise the agility or facility of one working with heavy piping to perform the tasks associated with lifting, lowering, stacking and repositioning of such piping, tubing, or other heavy cylindrically shaped objects. Resultant from the present structure, any pipes which may accidentally roll upon the fingers of a worker will encounter rigid bodies 28 and 30, which may be formed of materials such as wood, metal, or polycarbonate, thereby protecting the forward portion of the fingers of the user.

In the analysis of industrial accidents relating to pipes, it has been found that it is extremely rare that injury to the thumb of the worker will occur or that injury to the other fingers would occur below the knuckle area. It may thereby be appreciated that the instant invention, while not protecting a worker from every conceivable risk associated with the stacking and positioning of heavy piping will afford protection against the great majority of types of accidents that have been proven likely to occur in this industrial area.

Accordingly, what has been shown and described as preferred embodiment of the present invention is to be appreciated that the invention may be embodied otherwise and is here and specifically shown and described and, within said embodiment certain changes may be made in the form and arrangement of the part without department from the underlying idea or principles of this invention within the scope of the claims appended herewith.

Having thus described my invention what I claim as new, useful and non-obvious and, accordingly, secured by Letter Patent of the United States is:

1. A protective work glove system comprising:

(a) a thumb enclosure integrally extending outwardly from a palm portion of a work glove;

(b) a first enclosure integrally extending from said palm portion, said enclosure defining a volume therewithin for accommodation of middle and index fingers of a user, said enclosure having proximal and distal portions relative to said palm portion and having, secured within said first enclosure, a rigid body having an elongated structure, said body having a lateral cross-section substantially defining an isosceles triangle having its apex directed to the web space between said middle and index fingers, and body thereby tapered to approximate the natural rest position of the interdigital opening between said fingers, said rigid body further proportioned to about the height of said first enclosure and extending proximally from about a knuckle position of said enclosure and extending distally to the distalmost extent of said first enclosure; and (c) a second enclosure integrally extending from said palm portion, said enclosure defining a volume therewithin for accomodation of the ring and pinkie fingers of the user, said enclosure having proximal and distal portions relative to said palm portion and having, secured within said first enclosure, a rigid body having an elongated structure, said body having a lateral cross-section substantially defining an isosceles triangle having its apex directed to the web space between said ring and pinkie fingers, said body thereby tapered to approximate the natural rest position of the interdigital opening between said fingers, said rigid body further proportioned to about the height of said first enclosure and extending proximally from about said knuckle position of said enclosure and extending distally to the distal-most extent of said first enclosure.

2. The system as recited in claim 1 in which said rigid bodies are riveted within each of said first and second enclosures to prevent movement thereof.

3. The work glove as recited in claim 1 in which the material of said rigid bodies is related from the group consisting essentially of wood, metal or polycarbonate.

* * * * *